United States Patent [19]

Chang

[11] Patent Number: 4,964,319

[45] Date of Patent: Oct. 23, 1990

[54] SOCKET WRENCH DEVICE FOR ROTATING A SPARK PLUG

[76] Inventor: Yun-Chi Chang, No. 9-2, Lane 2, Sec. 2, Chang-Ping Rd., Pei-Tun Dist., Tai-Chung City, Taiwan

[21] Appl. No.: 407,919

[22] Filed: Sep. 15, 1989

[51] Int. Cl.[5] ..... B25B 13/00

[52] U.S. Cl. ..... 81/58.3; 81/121.1; 81/475

[58] Field of Search ..... 81/58.3, 475, 121.1, 81/125

[56] References Cited

U.S. PATENT DOCUMENTS 3,869,945 3/1975 Zerver ..... 81/125

4,090,121 5/1978 Czeczerski ..... 81/475

*Primary Examiner*—Frederick R. Schmidt

*Assistant Examiner*—Lawrence Cruz

*Attorney, Agent, or Firm*—Klauber & Jackson

[57] ABSTRACT

A socket wrench device is used to rotate a spark plug. The device includes a socket member with a socket to fit the spark plug. An endless series of ratchet teeth are provided on the socket member so as to engage with another endless series of ratchet teeth which are provided on a driving member. The driving member is retained on the socket member in such a manner that the ratchet teeth of the driving member are engaged removably with those of the socket member. An annular spring element is sleeved on the driving member so as to bias the two series of ratchet teeth to join together. When the device rotates the spark plug to an appropriate position in the cylinder of an internal combustion engine, an external torque which is applied to the device compresses the spring element, so that the ratchet teeth of the driving member are disengaged from those of the driving member, thereby stopping the rotation of the spark plug relative to the cylinder.

4 Claims, 6 Drawing Sheets

SOCKET WRENCH DEVICE FOR ROTATING A SPARK PLUG

BACKGROUND OF THE INVENTION

This invention relates to a socket wrench for rotating a spark plug, more particularly to a socket wrench device which can move a spark plug to a predetermined position in the cylinder of an internal combustion engine.

Referring to FIG. 1, the externally threaded portion 3 of a spark plug 1 is engaged within the threaded hole 4 of a cylinder cover 2. A hexagonal casing 5 is provided on a portion of the insulator 6 of the spark plug 1 so that a socket wrench can rotate the spark plug 1. Because the operator cannot accurately control the torque to tighten the spark plug 1 against the cylinder cover 2, the spark plug 1 may be overly or insufficiently tightened. In a situation where the spark plug 1 is too loose, the combustible mixture cannot be ignited thereby. When the spark plug 1 is too tight, the combustion chamber of the associated engine overheats, thereby resulting in damage to the electrodes of the spark plug 1. Furthermore, the excessive tightness of the spark plug 1 breaks the threads of both the spark plug 1 and the cylinder cover 2.

SUMMARY OF THE INVENTION

It is therefore the main object of this invention to provide a socket wrench device which can rotate a spark plug into the cylinder of an internal combustion engine so that the spark plug can obtain an appropriate tightness in the cylinder, which facilitates the effective ignition of the combustible mixture in the engine.

According to this invention, a socket wrench device is used to rotate a spark plug. The device includes a socket member with a socket to fit the spark plug. An endless series of ratchet teeth are provided on the socket member so as to engage with another endless series of ratchet teeth which are provided on a driving member. The driving member is retained on the socket member in such a manner that the ratchet teeth of the driving member are engaged removably with those of the socket member. An annular spring element is sleeved on the driving member so as to bias the two series of ratchet teeth to join together. When the device rotates the spark plug to an appropriate position in the cylinder of an internal combustion engine, an external torque which is applied to the device compresses the spring element, so that the ratchet teeth of the driving member are disengaged from those of the driving member, thereby stopping the rotation of the spark plug relative to the cylinder.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 2:
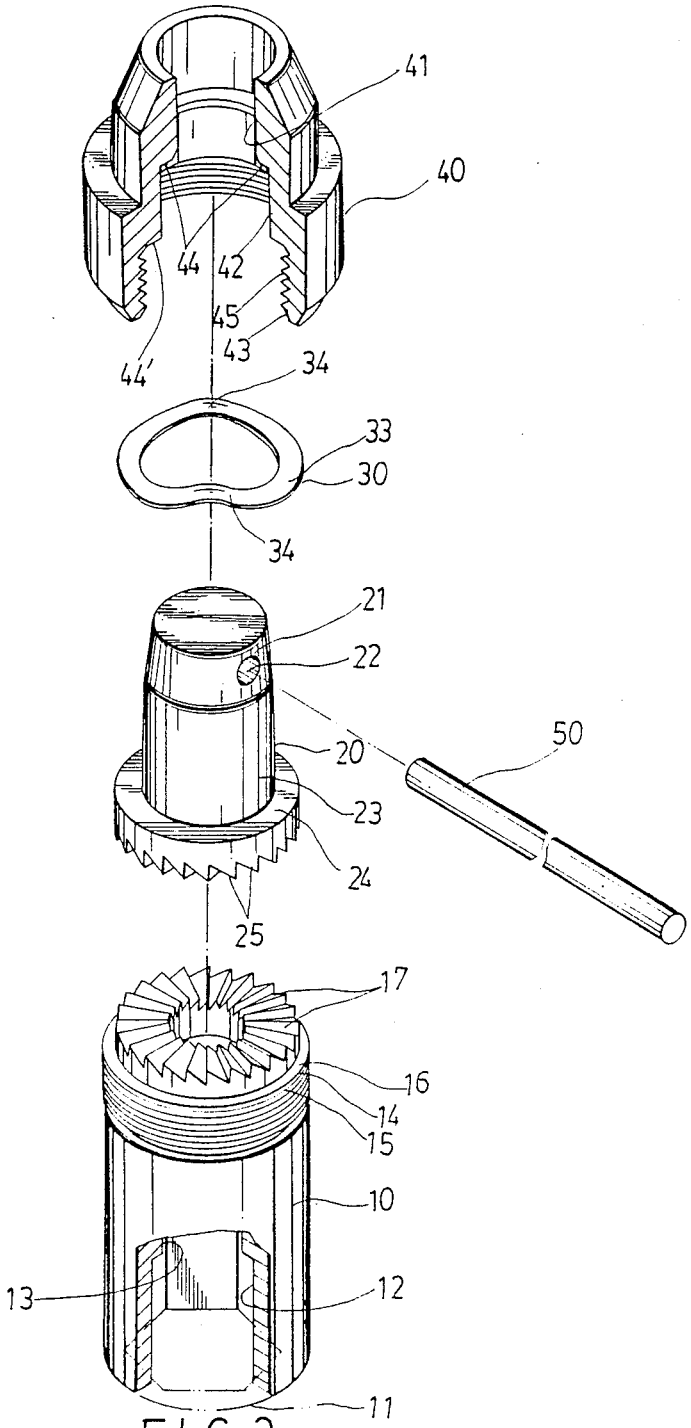
FIG. 2 is an exploded perspective view of a socket wrench device according to this invention.
Figure 3:
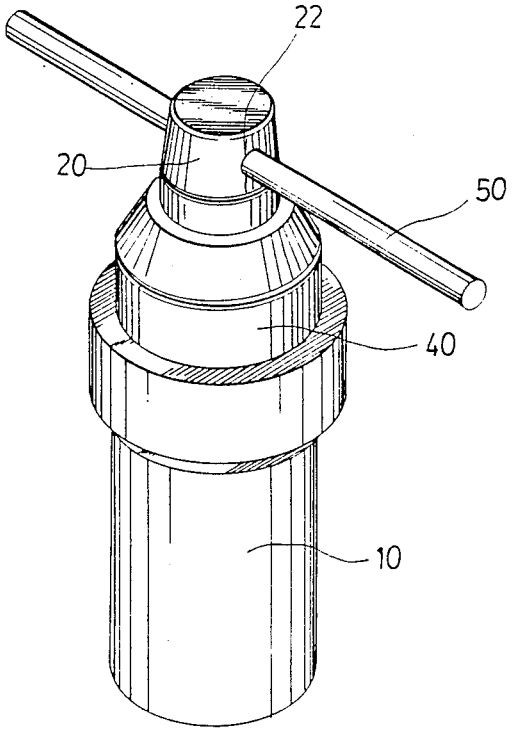
FIG. 3 is an assembled perspective view showing the socket wrench device of this invention.
Figure 4:
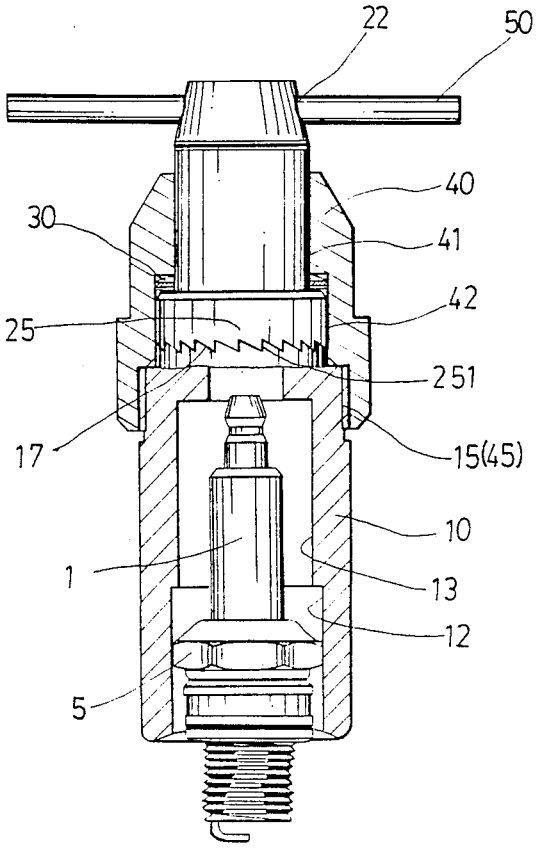
FIG. 4 is a partially sectional view showing the socket wrench device of this invention.

Referring to FIGS. 2–4, a socket wrench device of this invention includes a socket member 10, a driving member 20, a corrugated annular spring element 30, a retaining sleeve 40 and a rotary lever 50.

The socket member 10 has a bottom end surface 11 in which a hole is formed with a large hexagonal lower portion 12 and a small hexagonal upper portion 13. In use, the hexagonal casing 5 of the spark plug 1 is engaged within the large hexagonal lower portion 12 of the socket member 10. The top end portion 14 of the socket member 10 is provided with external threads 15. The top end surface 16 of the socket member 10 includes an endless series of ratchet teeth 17 provided on the intermediate portion thereof.

The top end portion 21 of the driving member 20 has a hole 22 formed therethrough. The lower end portion 23 of the driving member 20 has an outward flange 24. An endless series of ratchet teeth 25 are provided on the bottom end surface of the driving member 20.

The spring element 30 has two opposed low portions 33 and two opposed high portions 34. The biasing force of the spring element 30 is set according to the type of the spark plug 1.

The sleeve 40 has a small-inner-diameter upper portion 41, a middle-inner-diameter intermediate portion 42 and a large-inner-diameter lower portion 43. A small-diameter shoulder 44 is defined between the inner surfaces of the upper portion 41 and the intermediate portion 42, while a large-diameter shoulder 44' is defined between the inner surfaces of the intermediate portion 42 and the lower portion 43. The lower portion 43 has internal threads 45 which are engaged with the external threads 15 of the socket member 10, so that the driving member 20 and the spring element 30 are retained within the sleeve 40. The top end portion 21 of the driving member 20 extends from the top end of the sleeve 40 so as to expose the hole 22 in the driving member 20 to the exterior of the sleeve 40. The top end surface 16 of the socket member 10 is brought into contact with the large-diameter shoulder 44' of the sleeve 40 at the circumference thereof. The spring element 30 is interposed between the small-diameter shoulder 44 of the sleeve 40 and the flange 24 of the driving member 20 so as to push the ratchet teeth 25 of the driving member 20 to engage with the ratchet teeth 17 of the socket member 10.

The rotary lever 50 is passed through the hole 22 in the driving member 20 so as to rotate the driving member 20.

Figure 5:
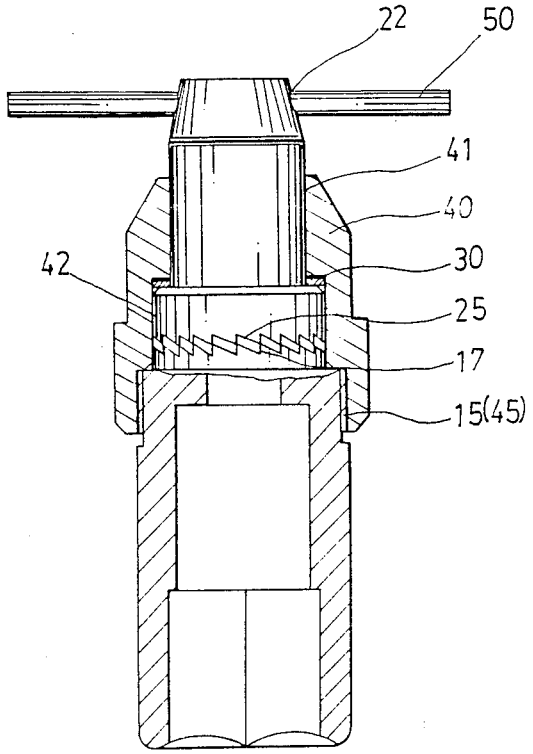
FIG. 5 is a schematic view illustrating the operation of the socket wrench device according to this invention.

When the wrench device initially rotates the spark plug 1 into the threaded hole 4 in the cylinder cover 2 in a direction in which the inclined side surfaces of the ratchet teeth 25 of the driving member 20 tend to slide over the inclined side surfaces of the ratchet teeth 17 of the socket member 10, the spring element 30 keeps the ratchet teeth 25 of the driving member 20 engaged with the ratchet teeth 17 of the socket member 10 due to the fact that the torque which is applied to the driving member 20 is used to rotate the spark plug 1. Referring to FIG. 5, as soon as the spark plug 1 is tightened against the cylinder cover 2 to an appropriate extent, the torque applied to the driving member 20 can overcome the biasing force of the spring element 30 so as to disengage the ratchet teeth 25 of the driving member 20 from the ratchet teeth 17 of the socket member 10. At the same time, the driving member 20 rotates in the sleeve 40 and cannot drive the socket member 10. Therefore, by using the socket wrench device of this invention, when the spark plug 1 is brought into the appropriate position in the cylinder cover 2, it is impossible to continue to rotate the spark plug 1. This positive location of the spark plug 1 in the cylinder cover 2 increases both the lifetime of the spark plug 1 and the combustion efficiency of the engine.

Figure 1:
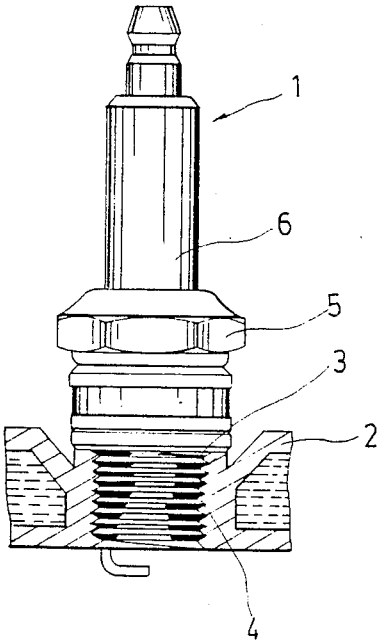
PRIOR ART FIG.1
FIG. 1 is a side view of a standard spark plug.

In the case shown in FIG. 1, when the driving member 20 is rotated in the opposite direction, the radial side surfaces of the ratchet teeth 25 of the driving member 20 push the radial side surfaces of the ratchet teeth 17 of the socket member 10 so as to loosen the spark plug 1 from the cylinder cover 2.

Figure 6:
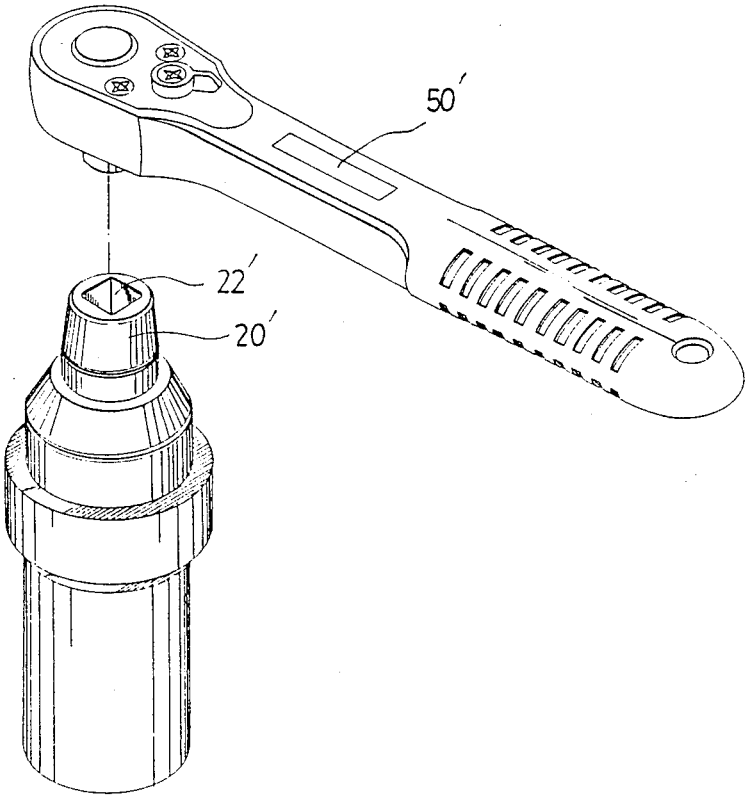
FIG. 6 is a perspective view showing another socket wrench device of this invention.

FIG. 6 shows an alternative embodiment of this invention. As illustrated, the driving member 20' of the socket wrench device has a square hole 22' formed in the top end surface thereof. The square adapter of a ratchet wrench 50' can be engaged with the square hole 22' so as to rotate the driving member 20'.

With this invention thus explained, it is apparent that numerous modifications and variations can be made without departing from the scope and spirit of this invention. It is therefore intended that this invention be limited only as indicated in the appended claims.

I claim:

1. A socket wrench device for rotating a spark plug, said spark plug having a hexagonal intermediate portion and an externally threaded portion, said device comprising:

a socket member, having a first end surface and a second end surface, including a hexagonal hole formed in said first end surface thereof, an endless series of ratchet teeth provided on an intermediate portion of said second end surface of said socket member, and an externally threaded portion positioned near said ratchet teeth, said hexagonal hole being shaped in conformity with said hexagonal intermediate portion of said spark plug;

a driving member including an endless series of ratchet teeth provided on an end surface thereof engaging with said ratchet teeth of said socket member, an outward flange extending from said driving member, and a hole formed in said driving member;

an annular spring element sleeved on said driving member; and a retaining sleeve having a large-inner-diameter portion located at an end thereof, a small-inner-diameter portion located at the other end of said sleeve, a middle-inner-diameter portion interposed between said small-inner-diameter portion and said large-inner-diameter portion, a large-diameter shoulder defined between inner surfaces of said large-inner-diameter portion and said middle-inner-diameter portion, and a small-diameter shoulder defined between inner surfaces of said middle-inner-diameter portion and said small-inner-diameter portion, said large-inner-diameter portion having a threaded inner surface engaged threadably with said externally threaded portion of said socket member so as to retain both said driving member and said spring element on said socket member, said spring element being brought into contact with said small-diameter shoulder of said sleeve at one end surface thereof and with said flange of said driving member at the other end surface thereof so as to bias said ratchet teeth of both said socket member and said driving member to join together, a circumference of said second end surface of said socket member being brought into contact with said large-diameter shoulder of said sleeve, both said socket member and said retainer being capable of rotating with said driving member when said driving member is initially rotated to screw said spark plug into a threaded hole of a cylinder of an internal combustion engine;

whereby, when subsequent continuous rotation of said wrench device tightens said spark plug against said cylinder to a predetermined extent, an external torque which is applied to said wrench device compresses said spring element, so that said ratchet teeth of said driving member are disengaged from said ratchet teeth of said driving member, thereby stopping rotation of said spark plug relative to said cylinder.

2. A socket wrench device as claimed in claim 1, wherein said spring element is corrugated.

3. A socket wrench device as claimed in claim 1, wherein said hole in said driving member is a hole formed through an end portion of said driving member, whereby, a rotary lever can be inserted through said hole of said driving member so as to rotate said driving member.

4. A socket wrench device as claimed in claim 1, wherein said hole in said driving member is square-shaped and is formed in the other end surface of said driving member, whereby, an adapter of a ratchet wrench can be engaged with said square hole of said driving member so as to rotate said driving member.

* * * * *